US007089869B2

(12) United States Patent
Okada et al.

(10) Patent No.: US 7,089,869 B2
(45) Date of Patent: Aug. 15, 2006

(54) METHOD OF MANUFACTURE OF STRUCTURAL BODY AND STRUCTURAL BODY

(75) Inventors: Norihisa Okada, Hikari (JP); Masaki Yono, Kudamatsu (JP); Wataru Kawamura, Kudamatsu (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/000,073

(22) Filed: Dec. 4, 2001

(65) Prior Publication Data

US 2002/0073888 A1 Jun. 20, 2002

(30) Foreign Application Priority Data

Dec. 20, 2000 (JP) ..... 2000-386259

(51) Int. Cl.
*B61D 17/00* (2006.01)
*B60R 13/04* (2006.01)

(52) U.S. Cl. ..... 105/402; 296/191

(58) Field of Classification Search ..... 105/396, 105/401, 397, 402; 296/191, 29, 30; 29/897.2, 29/462, 509
See application file for complete search history.

(56) References Cited

U.S. PATENT DOCUMENTS 2,294,357 A * 9/1942 Dean et al. ..... 105/397
2,468,591 A 4/1949 Dean
3,151,574 A * 10/1964 Dean ..... 105/402
4,211,173 A * 7/1980 Eggert, Jr. ..... 105/402
4,353,313 A * 10/1982 Panagin ..... 105/397
5,458,066 A * 10/1995 Ishida et al. ..... 105/401

FOREIGN PATENT DOCUMENTS

| | | |
|---|---|---|
| DE | 19612342 | 7/1997 |
| EP | 477727 A2 * | 9/1991 |
| EP | 0477727 | 4/1992 |
| EP | 0962373 | 12/1999 |
| JP | 04054764 | 5/1992 |
| JP | 06001234 | 1/1994 |
| JP | 2000334581 | 12/2000 |

* cited by examiner

*Primary Examiner*—S. Joseph Morano
*Assistant Examiner*—Robert J. McCarry, Jr.
(74) *Attorney, Agent, or Firm*—Antonelli, Terry, Stout and Kraus, LLP.

(57) ABSTRACT

A flange 52*b* is provided on a plate by bending the plate, the flange being substantially orthogonal to the plate, and a recessed portion, where the flange is missing, is provided between two flanges. A flange 62*c* is provided by bending another plate, and a raised portion is provided which protrudes from a parallel side 62*b* to flange 62*c* at an end portion of flange 62*c*. An end portion of flange 52*c* and end portion of flange 62*c* are abutted, and end portion of plate 60 is abutted to an outer side of the circular arc portion of flange 52*b* from the plate. The raised portion is abutted to the recessed portion, and respective abutted portions are welded. Where two plates in which a flange is provided by bending the plate are intended to be welded, the occurrence of a space in a welding portion can be prevented.

39 Claims, 7 Drawing Sheets

METHOD OF MANUFACTURE OF STRUCTURAL BODY AND STRUCTURAL BODY

BACKGROUND OF THE INVENTION

The present invention relates to a method of manufacturing a unitary structural body, without a gap, from plural body members having a flange by joining an end portion of one plate to an end portion of another plate; and, in particular, the invention relates to a method of manufacture suitable for production of an end structure constituting an end portion of a railway vehicle.

As shown in Japanese patent No. 2,692,459 (U.S. Pat. No. 5,488,770), a car body of a railway vehicle typically has a hexahedron-shaped body. An end portion of the railway vehicle is referred to as an end structure. In the end structure, there is provided a passage or door for allowing passengers to come and go to an adjacent car.

For this reason, the end structure requires two plates constituting a panel on the right side of the passage and a panel on the left side of the passage and a plate for constituting a panel above the passage. Since the three plates join a roof structural body member and a side structural body member, the outer side edges of the three plates each have a flange. Further, the end portions of the three plates have reinforcement flanges.

In the prior art, a product in the form of a plate having a flange along a side of the plate is manufactured by press forming, in which the plate is placed between a female die and a male die. Since a female die and a male die are required for such processing, the cost of manufacture becomes high.

For the above reason, respective L-shaped plates are welded using spot welding and one side of the L-shaped plate forms the above-stated flange.

As a means for avoiding the need for a male metal die, a forming method using only a female die has been proposed, as shown in FIG. 18 to FIG. 20 of Japanese application patent laid-open publication No. Hei 11-310,371. In this method, on the female die, an outer peripheral portion of a plate of raw material is fixed and the raw material is pushed in using a rod shape tool moving along an inner peripheral face of the female die. The tool is moved and the plate is subjected incrementally to a buckling processing.

On the other hand, in Japanese application patent laid-open publication No. Hei 10-76,321, a method is disclosed in which a squeezing processing is carried out incrementally.

The construction shown in FIG. 13 will be explained by way of example. On three plates 1, 2, 3, after flanges 1*b*, 1*c*, 1*d*, 2*b*, 2*c*, 2*d*, 3*b*, 3*c*, 3*d* have been provided. The flanges 1*b*, 2*b* of the right and the left plates 1, 2 are overlapped, and these flanges 1*b*, 2*b* are subjected to spot welding and are formed as one body. The flanges are provided as an integral part of the body by bending the plates 1, 2, 3. Further, the flanges 1*c*, 3*c*, 2*c* are overlapped by a roof structural body 30 and welded.

The reference numeral 45 denotes a passageway for passengers. The respective three plates 1, 2, 3 are continued to the adjacent flange and the connection portion has a circular arc shape. In this case, to a joining portion between the right and the left plates 1, 3, the central plate 2 and the roof structural body 30, a space exists. This space must be closed with another plate to prevent rain and other elements for entering the space. The closing work requires a high cost. Further, the outer appearance becomes unattractive.

Further, the flanges are formed by bending the plate, so that a cross-section thereof has the circular arc shape. For this reason, a groove is provided between the right and left plates, with the result that the outer appearance becomes unattractive.

In the incremental forming method, since the metal die is in the form of a single die, the manufacture can be carried out with a low cost. However, in the incremental forming method, as described in the above-stated Japanese application patent laid-open publication Hei 11-310,371, the flange is formed to the end portion, but the plate is left on the outer peripheral portion of the flange. Thus, in a case where the plate is unnecessary, it is necessary to cut off and remove the outer peripheral portion of the flange.

Further, according to this incremental forming method, when the flange is formed, the angle between the flange and the bottom plate is not a right angle, however it works. For example, when a cylinder is joined by overlapping the flange, and the flange has a right angle, it is difficult to carry out overlapping joining.

Further, it is difficult to form a flange having a substantial height. For this reason, it is difficult to overlap the flange of one member and a flange of another member.

On the other hand, according to the processing method described in the above-stated Japanese application patent laid-open publication No. Hei 10-76,321, when the flange is processed, a wrinkle can occur easily in the joining portion between the one flange and the other flange.

SUMMARY OF THE INVENTION

An object of the present invention is characterized in that, when two plates having a flange and a third plate are joined, the occurrence of a space in a joining portion can be prevented.

The above-stated object can be attained by a method of manufacture of a structural body, which includes the steps of producing a first plate and a second plate, for abutting and welding the first plate, the first plate comprising a first flange provided by bending a first side of the first plate, a second flange, which is substantially orthogonal to the first flange and is provided by bending a second side of the first plate, and a recessed portion where there is no flange between an end portion in a longitudinal direction of the first flange and an end portion in a longitudinal direction of the second flange, the second plate comprising a third flange provided by bending a first side of the second plate and for connecting the end portion in the longitudinal direction of the first flange, and a raised portion which protrudes from a third side, which is substantially orthogonal to the first side and a second side being parallel substantially to the first side and in an end portion in a longitudinal direction of the third flange and in a vicinity of the end portion; abutting the end portion in the longitudinal direction of the first flange and the end portion of the longitudinal direction of the third flange; abutting the third side to an outer side of a circular arc of the second flange from the first plate; inserting and abutting the raised portion to the recessed portion; and welding the respective abutted portions.

DESCRIPTION OF THE INVENTION

A first embodiment of a method of manufacturing a structural body according to the present invention will be explained with reference to FIG. 1 to FIG. 12.

Figure 6:
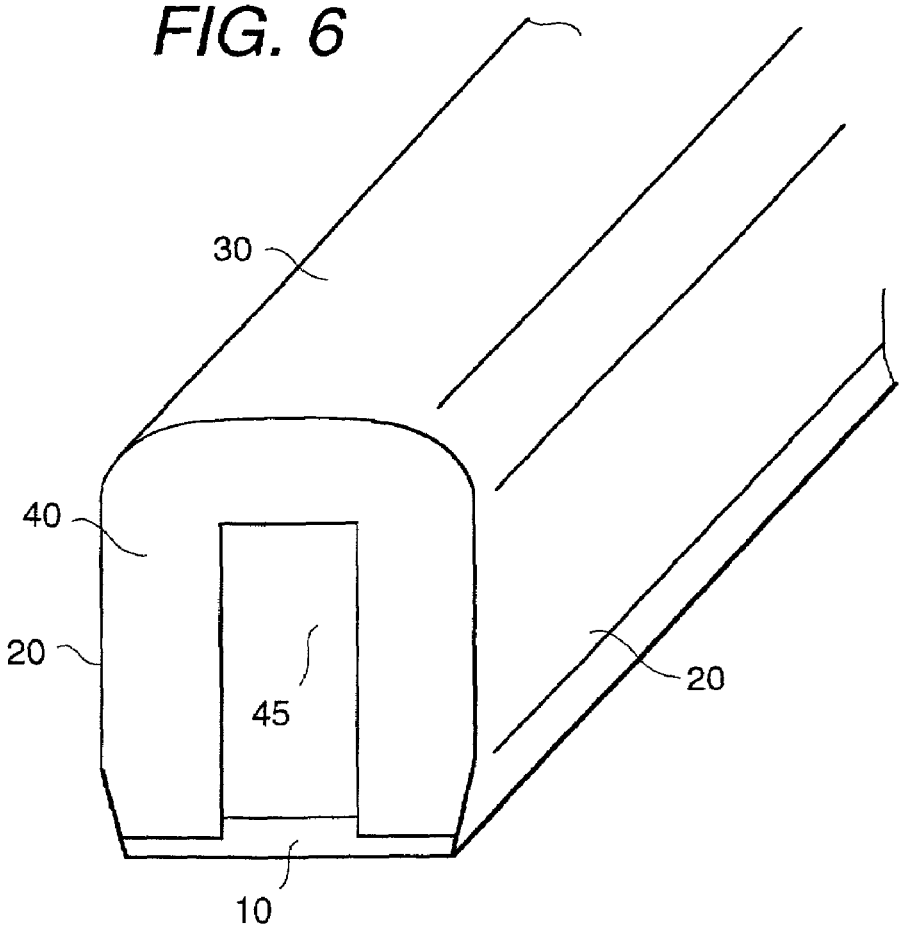
FIG. 6 is a perspective view of an end structure of a car body representing one embodiment according to the present invention.

FIG. 6 shows mainly a rear half portion of a car body. The car body comprises a stand flame 10 constituting a floor, a side structural body 20 constituting a side face, a roof structural body 30, and an end structural body 40 for closing the rear end portion of the car body.

Figure 1:
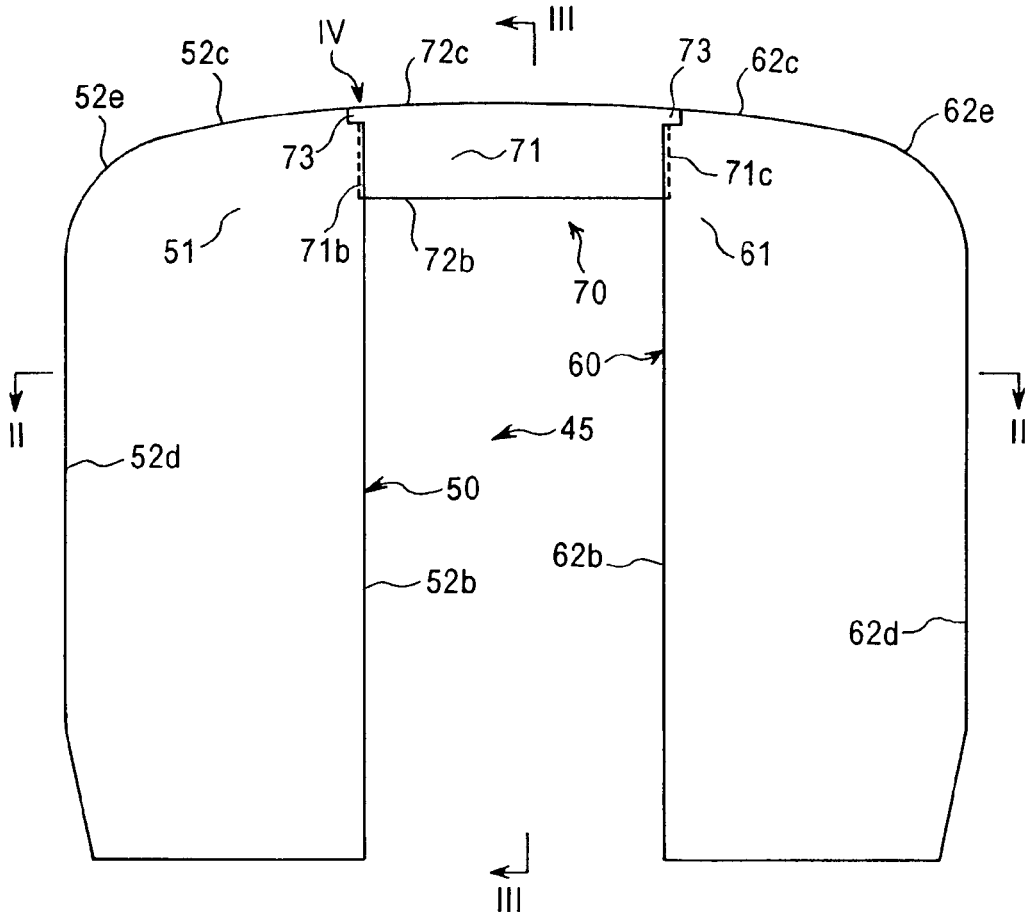
FIG. 1 is a plan view of an end structure of a car body representing one embodiment according to the present invention.
Figure 2:
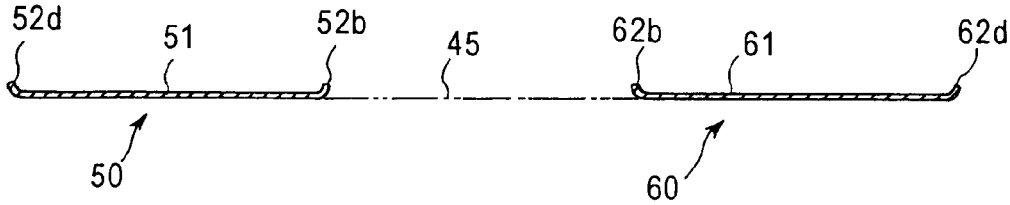
FIG. 2 is cross-sectional view taken along line II—II in FIG. 1.

As seen in FIG. 1, the end structural body 40 comprises a passage 45 for the passengers, a plate 50 constituting a left side thereof, a plate 60 constituting a right side thereof, and a plate 70 constituting an upper portion above the passage 45.

The right and the left plates 50 and 60 are of substantially quadrangular shape, and to the edge portions, except for the bottom edge of each plate, flanges 52*b*, 52*c*, 52*d*, 62*b*, 62*c*, 62*d* are provided. The flange 52*b* (62*b*) is a flange which is on one side of the passage 45. The flange 52*c* (62*c*) is a flange which overlaps the roof structural body 30. The flanges 52*d*, 52*e* (62*d*, 62*e*) are flanges which overlap the side structural body 20.

Figure 4:
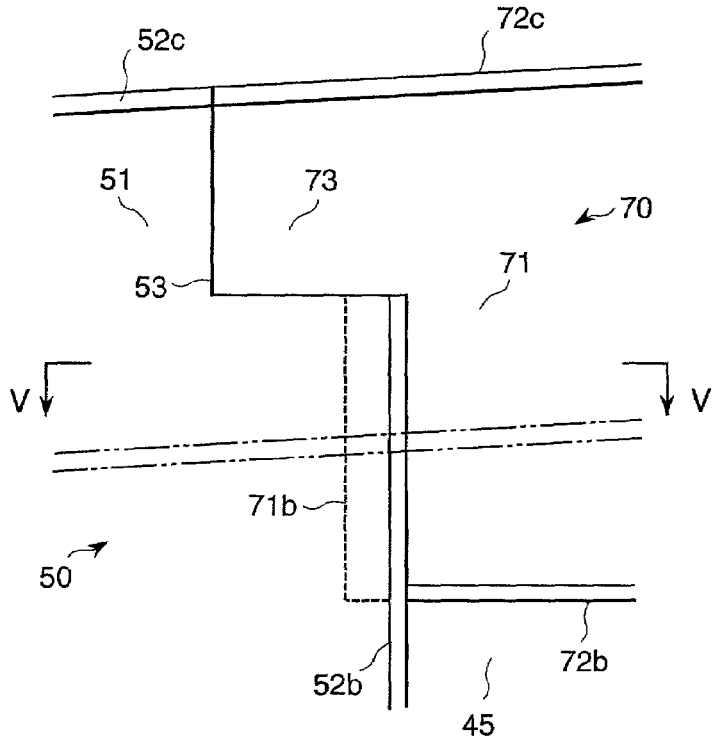
FIG. 4 is an enlarged view of a portion IV in FIG. 1.

At a joining portion disposed between the upper end of the vertical flange 52*b* (62*b*) and the end of flange 52*c* (62*c*), no flange is provided. Thus, the two flanges form a non-continuous portion in which no flange is provided. As seen in FIG. 4, a portion of the plate 51 (61) is cut out, and a quadrangular-shaped recessed portion 53 (63) is formed thereby. The size of the recessed portion 53 (63) will be described later.

Figure 3:
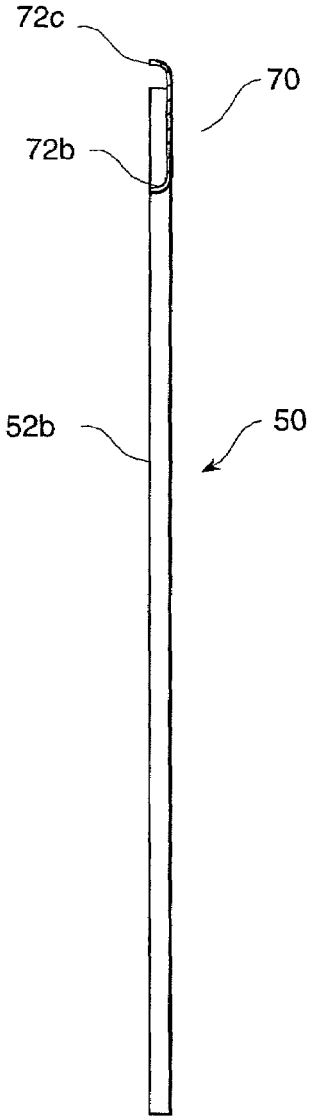
FIG. 3 is cross-sectional view taken along line III—III in FIG. 1.

The plate 70 constituting the upper portion above the passage 45 for the passengers is of substantially quadrangular shape and has flanges 72*b* and 72*c* along the lower side and the upper side, respectively, as seen in FIG. 3. The flange 72*c* is mounted so that it overlaps the roof structural body 30.

Figure 5:
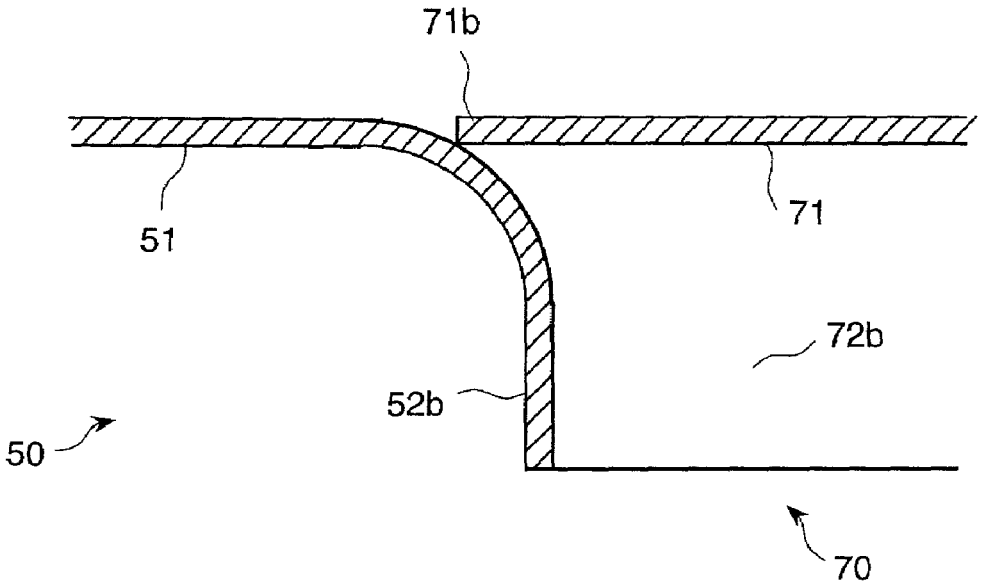
FIG. 5 is cross-sectional view taken along line V—V in FIG. 4.

As seen in FIG. 5, end portions on the left side 71*b* and a right side 71*c* of the plate 70 are abutted against the bent circular arc-shaped outer face at which the flange 52*b* (62*b*) protrudes from the plate portion 51 (61). This abutted portion is subjected to welding. The plate portion 51 (61) of the plate 50 (60) is coextensive with the plate portion of the plate 71. Further, this abutting welding is performed by fillet welding.

The right and the left end portions of the flange 72*c* and the plate portion 71 in the vicinity of the flange each have an extension portion 73, as seen in FIG. 4, which enter the recessed portion 53 (63) of the plate 50 (60). The abutting portion between the recessed portion 53 (63) and the extension portion 73 is welded. At an upper edge of the extension portions 73, the flange 72*c* continues. The end of the flange 52*c* (62*c*) and the end portion of the flange 72*c* are abutted and welded, as seen in FIG. 4.

The end portions on a lower side 72*b* of the plate 70 are abutted against the flanges 52*b*, 62*b* and welded. An end portion of the bottom plate 71 between the extension portions 73 and the flange 72*b* protrudes from the end of the flange 72*b*.

The abutted portions described above are welded continuously so that no water leakage occurs. The welded portions are cut off by grinding and are formed smoothly.

The flange 52*e* (62*e*), forming the connection portion between the flange 52*c* (62*c*) and the flange 52*d* (62*d*), has a circular arc shape.

The directions of protrusion of the flanges 52*b*, 52*c*, 52*d*, 52*e*, 62*b*, 62*c*, 62*d*, 62*e*, 70*b*, 70*c* are substantially orthogonal to the faces of the plate portions 51, 61, 71. Accordingly, when the flanges 52*c*, 52*d*, 52*e*, 62*c*, 62*d*, 62*e*, 70*c* are overlapped to an inner side of the end portions of a side structural body 20 and the roof structural body 30, they overlap in parallel, so that good welding can be attained. The lower ends of the right and the left plates 50, 60 are overlapped on the stand frame 10 and are welded.

The plates 50, 60, 70 have a plurality of reinforcement ribs on the inner side of the car body and on the outer side of the car body, but they are not shown in the figure. For example, a rib may be formed of another member spot welded to the plates 50, 60, 70. Further, the plates 50, 60, 70 are provided integrally by plastic processing.

According to the above, at the joint portion between the plate 70, the plate 50 (60) and the roof structural body 30, there is no gap after joining is carried out. Further, in the joint between the plate 70 and the plate 50 (60), there is no circular arc-shaped groove of the flange, so that a good outer appearance can be obtained.

Figure 7:
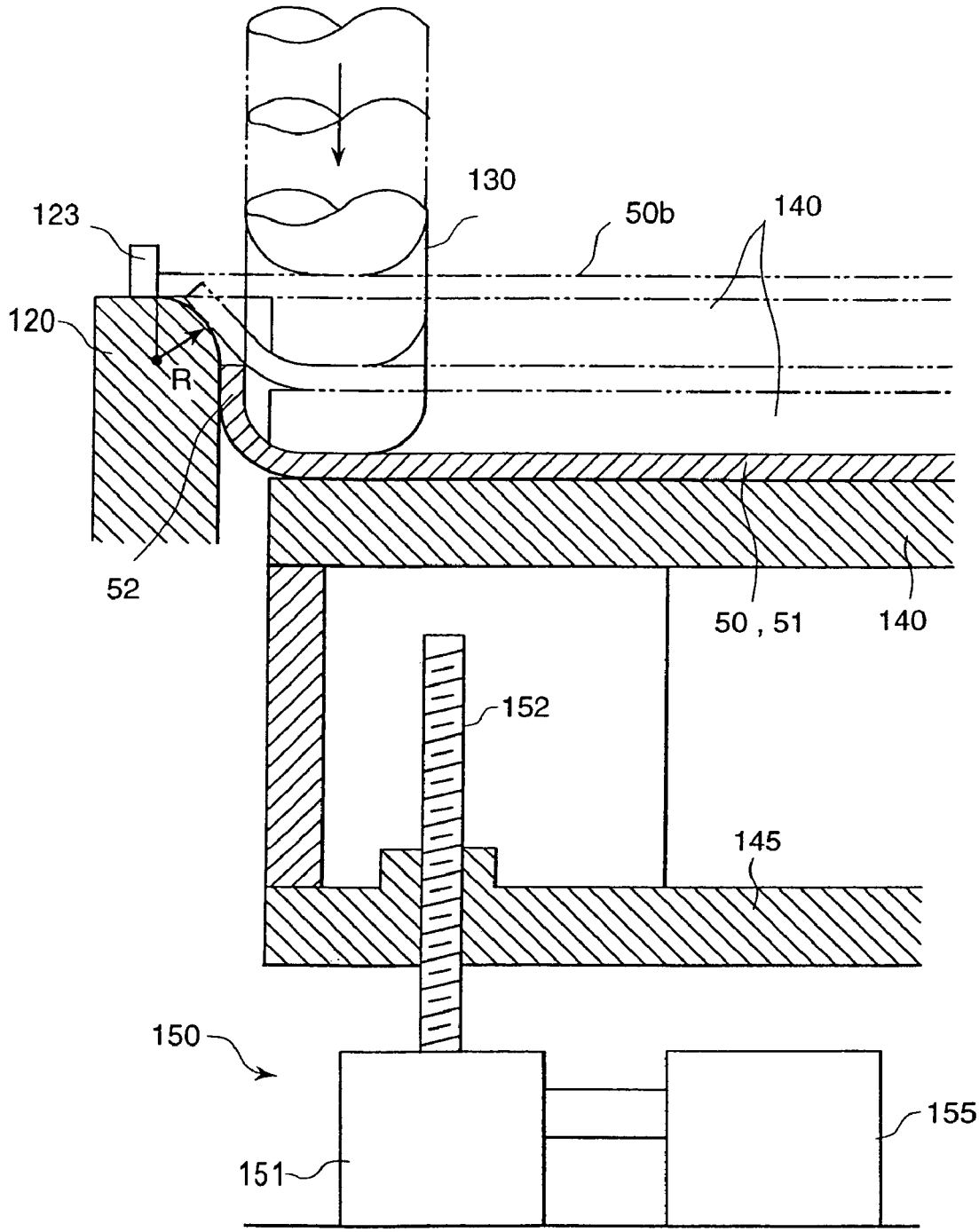
FIG. 7 is a longitudinal cross-sectional view of a portion of an incremental forming apparatus.

Next, the method of manufacturing the plates 50, 60 and 70 will be explained with reference to FIG. 7 to FIG. 10. This plate manufacturing method is carried out according to the incremental forming method. FIG. 7 shows only a left end portion of the incremental forming apparatus. The other portions have suitably the same construction.

The forming of the plate 50 will be explained by way of example. A metal die 120, which represents a female die (an outer die), is disposed horizontally. On an upper face of the female die 120, a plate 50 formed of raw material is mounted. Into an interior portion of the female die 120, a rod-shaped tool 130 is inserted. The tool 130 is lowered by an incremental amount along a vertical face of the female die 120, and then it is moved circumferentially along the inner peripheral face of the female die 120. The shape of the inner peripheral face of the female die 120 corresponds to the desired outer diameter shape of the plate 50.

When the tool 130 has been moved enti8rely around the inside of the female die 120, the tool 130 is incrementally lowered again and the above function is repeated. Accordingly, the flat plate 50*b* of raw material is subjected to the squeezing processing. Further, the descending movement of the tool 130 is a movement in the squeezing processing direction. This is substantially a movement in the axial direction of the tool 130 and is a movement in the depth direction of the product being formed.

The tip end of the tool 130 is flat, and from the tip end to the side face of the tool 130, the surface has a circular arc shape to form a corner portion. The circular arc-shaped portion forms the flanges 52*b*, 52*c*, 52*d* as the flat tip end rests on the bottom plate 51 of the plate 50. The tool 130 is lowered down while it is allowed to rotate with a body (not shown in figure) coupled to the upper portion of the tool. The tool 130 also moves circumferentially along an inner peripheral face (which corresponds to the portions where the flanges 52*b*, 52*c*, 52*d* are formed) of the female die 120.

Since the tool 130 moves by contacting the raw material 50*b*, the tool 130 rotates (rotates on its axis) as a follower. Accordingly, the tool 130 is not in contact at only one point with the raw material 50*b*, so that a blazing phenomenon can be prevented. Further, a lubricating oil is coated on the upper face of the raw material 50*b*.

On the upper face of the female die 120, plural positioning pins (guides) 123 are mounted. When the flat plate of the raw material 50*b* is placed on the upper surface of the female die 120, the pin 123 contact the outer peripheral edges of the raw material 50*b*, so that accurate positioning is carried out. The upper end (called a shoulder portion) of the inner peripheral side of the female die 120 has the shape of a circular arc. This circular arc exists along the whole periphery of the female die 120. Due to this circular arc shape, the outer peripheral portion of the raw material 50*b* moves smoothly into the inside of the female die 120 when pressed by the tool 130. The position etc. of the circular arc portion of the shoulder portion of the female die 120 will be further described later.

The interior portion of the female die 120 has no bottom. In the open interior portion of the female die 120, a seat 140 is provided for mounting the raw material 50*b*. The seat 140 is supported by a mechanism 150 which can carry out operations to control the height thereof. The seat 140 is provided in a location which opposes tip portion (lower end) of the tool 130. The seat 140 is provided on a portion which corresponds to a track extending in the peripheral direction of the tool 130. Namely, the raw material 50*b* is sandwiched by the tip end of the tool 130 and the seat 140. Further, the seat 140 is provided in the central open area of the female die 120. Accordingly, the central portion of the raw material 50*b* can be supported on the seat 140.

The seat 140 supports the raw material 50*b* and fixes it in position. The fixing is carried out using magnetic force provided an electromagnet. Or, on an upper face of the seat 140, a vacuum adsorption pad may be provided, whereby the fixing is carried out using vacuum adsorption. The fixing position is located at a central portion of the seat 140. The raw material 50*b* is made of a steel system metal, a stainless system metal, and an aluminum alloy system metal.

The means 150 for raising and lowering the seat 140 will be explained. The means 150 is comprised of plural screw mechanisms 151. In FIG. 7, one of a pair of the screw mechanisms 151 is shown. A seat 145 disposed below the seat 140 is supported on a screw rod 152. On the seat 145, a rotatable free nut is provided which engages with the screw rod 152. With the rotation of a drive mechanism 155, the screw 152 rotates and the seat 140 is lowered or raised. Further, between the seat 140 or the seat 145 and a base, plural guides (not shown in figure) for vertically guiding the raising and lowering of the seat 140 are provided. The means 150 and the female die 120 are supported on the base.

The incremental forming method will be explained. The raw material 50*b* is a flat plate, which is developed into a desired size and shape based on the produce to be formed. In the above-stated development, the size of the plate is calculated according to the surface area and the volume of the product to be formed, similar to the squeezing forming method of the corner portion. Or, it is determined according to experimentation.

On the basis of the set development size, the plate is cut off using a tartlet punch press etc., during which the bridging portion between the flange 52*b* and the flange 52*c* is removed. Further, the recessed portion 53 is carried out. The development shape of the raw material 50*b* is determined according to the above stated factors.

Next, the raw material 50*b* is mounted on the upper side of the female die 120. At this time, the raw material 50*b* is supported on the seat 140, which has been raised to the level of the top of the female die 120, and is positioned by the pins 123. Then, the raw material 50*b* is fixed to the seat 140 at a central portion thereof using a magnetic force or vacuum adsorption, as stated previously.

Next, the seat 140 is lowered by an incremental amount and the tool 130 is then lowered. The position to which the tool 130 is lowered is a position where the side face of the tool 130 and the vertical face (the inner peripheral face, the linear portion) of the female die 120 face each other with the raw material 50*b* positioned therebetween. Namely, the raw material 50*b* is sandwiched between the inner peripheral face of the female die 120 and the side face of the tool 130. Under this condition, the tool 130 is moved circumferentially in the peripheral direction along the inner peripheral face of the female die 120.

The amount by which the tool 130 is lowered is such that the tip end of the tool 130 contacts the raw material 50*b*. For example, before the lowering of the seat 140, when the upper face of the seat 140 is positioned at the same level as the upper face (the on which the end portion of the raw material 50*b* is mounted) of the female die 120, when the tip end of the tool 130 is in contact with the upper face of the raw material 50*b*, the seat 140 and the tool 130 are lowered by the same incremental amount. Both the seat 140 and the tool 130 can be lowered at the same time.

In this embodiment according to the present invention, if the bottom plate 51 is wide and the plate thickness is thin and the central portion of the bottom plate 51 is fixed, since the bottom plate portion 51 is bent, it is unnecessary to bend the outer peripheral portion of the bottom plate portion 51 according to the shape of the female die 120. Accordingly, the raw material 50*b* may tend to incline. Further, as stated in a latter portion, when the tool 130 is moved circumferentially in the peripheral direction, the raw material 50*b* may tend to rotate. Accordingly, the raw material 50*b* is fixed to the seat 140.

The position to which the tool 130 is lowered is a position in which the flanges 52*b*, 52*c* and 52*d* begin to be formed between the side face of the tool 130 and the inner peripheral face of the female die 120. Further, consideration is given to the rectangular angle of the flanges 52*b*, 52*c*, 52*d*. When the rectangular angle is taken into consideration, the tool 130 is positioned so as to sandwich the raw material 50*b* between the side face of the tool 130 and the inner peripheral face of the female die 120.

Next, the tool 130 is moved circumferentially along the inner peripheral face of the female die 120. The tool 130 rotates as a follower at this time. The raw material 50*b* is formed progressively in accordance with the circumferential movement of the tool 130. Every time the tool 130 has been moved through one cycle around the periphery in this way, the seat 140 is lowered and the tool 130 is also lowered. The incremental amounts by which the tool 130 and the seat 140 are moved and the position of the tool 130 are stated. Then, the tool 130 is once again moved circumferentially along the inner peripheral face of the female die 120.

Thereafter, the incremental lowering of the seat 140 and the tool 130 and the circumferential movement of the tool 130 in the peripheral direction around the inner periphery of the die 120 are repeated. By repetition of the above-stated process, the outer peripheral portion of the raw material 50*b* is progressively moved into the opening defined by the inner peripheral face of the female die 120. With this, a squeezing processing is carried out. The axial direction of the tool 130 represents the squeezing processing direction. The direction of movement of the tool 130 circumferentially along the inner peripheral face of the female die 120 is a movement in the radial direction of the tool 130.

According to this embodiment of the present invention, the raw material 50*b* is progressively deformed in a narrow portion between the female die 120 and the tool 130, and, since a small and homogeneous strain is applied incrementally, a good flat face on the bottom plate portion 51 can be maintained.

In addition to the above, since the flanges 52*b*, 52*c*, 52*d* are formed by restraining the raw material 50*b* over the entire periphery thereof, the flanges 52*b*, 52*c*, 52*d* are not expanded toward the outer side, and a product having a superior rectangular degree between the flat plate portion and the flange portion can be manufactured.

In particular, since the circular arc-shaped flange of the connection portion between the flange 52*c* and the flange 52*d* is made wide relative to the outer side according to this forming process, and since the flanges 52*c*, 52*d* are restrained relative to the outer portion by the female die 120, vertical flanges 52*c*, 52*d* can be formed. Namely, over the entire range from the beginning of the squeezing process to the finish process, since the flange is sandwiched between the inner peripheral face of the female die 120 and the side face of the tool 130, the squeezing processing can be carried out by restraining the flanges from the outer portion and from the inner portion. As a result, a processing which ensures the desired accuracy of the rectangular degree etc. can be carried out.

As stated above, in the incremental forming using the female die 120, the seat 140 is provided inside the opening of the female die 120 and the raw material 50*b* is fixed to this seat 140, so that a predetermined forming of the raw material 50*b* can be attained. Further, as the forming proceeds, the flange is positioned in contact with the vertical face of the female die 120.

Further, the inner corner at the top surface of the female die 120 is contoured toward the inner peripheral face of the female die 120 so that a squeezing processing can be carried out; and, further, the end portion of the female die 120 is positioned in the inner peripheral face of the female die 120 and the squeezing processing is carried out. Accordingly, a good rectangular degree between the flange and the bottom face portion 51 can be obtained. Further, the height of the formed flange can be large.

Further, since the peripheral portion of the raw material 50*b* is moved into the female die 120 as the squeezing processing is carried out, when the fatigue due to the forming of the raw material 50*b* is taken into the consideration, after the forming, it is unnecessary to cut off the end portion of the flange.

Since a high load as experienced in press processing is not necessary, the female die 120 can be formed with a single material, such as a general steel material, so that thermal treatment, such as sintering, and minute surface finishing, such as needed after use of a press metal die, are not necessary.

The movement of the tool 130 will be explained in more detail. The plate 50 has the flanges 52*b*, 52*c*, 52*d* on three sides of the panel of quadrangular shape and no flange is provided on the fourth side. Accordingly, the circular arc portion of the shoulder of the female die 120 is provided along only three sides. On the fourth side, the raw material 50*b* is not mounted on the upper surface of the female die 120. Rather, a gap is formed therebetween.

Figure 8:
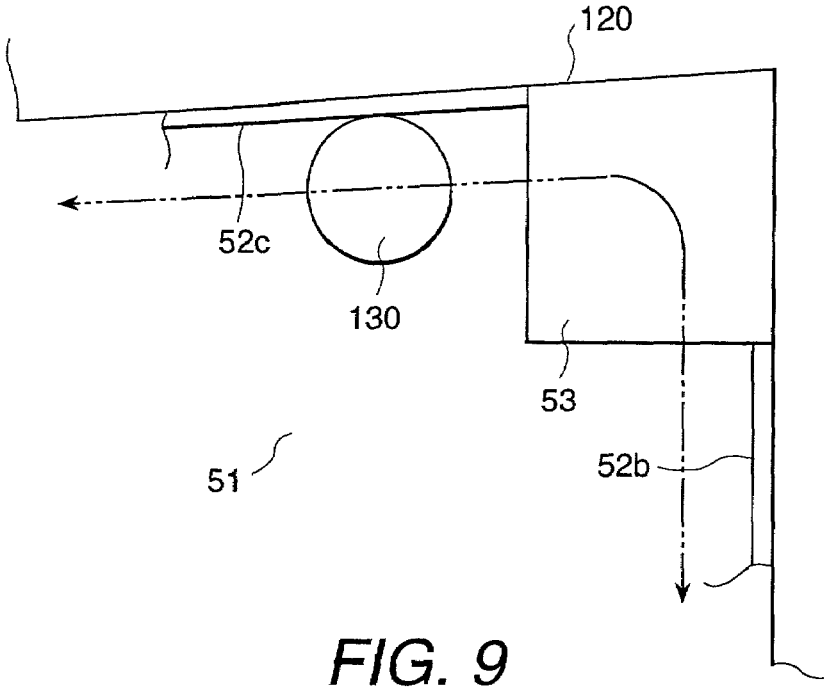
FIG. 8 is a plan view of the area between a flange 52*b* and a flange 52*c* at a midway point of the forming process.

The tool 130 moves in the direction from one end side of the flange 52*b* to the flange 52*c*; and, through the flange 52*c*, the tool 130 moves in the direction of the end portion of the flange 52*d*. The track along which the tool 130 moves in the recessed portion 53 is shown in FIG. 8.

Figure 9:
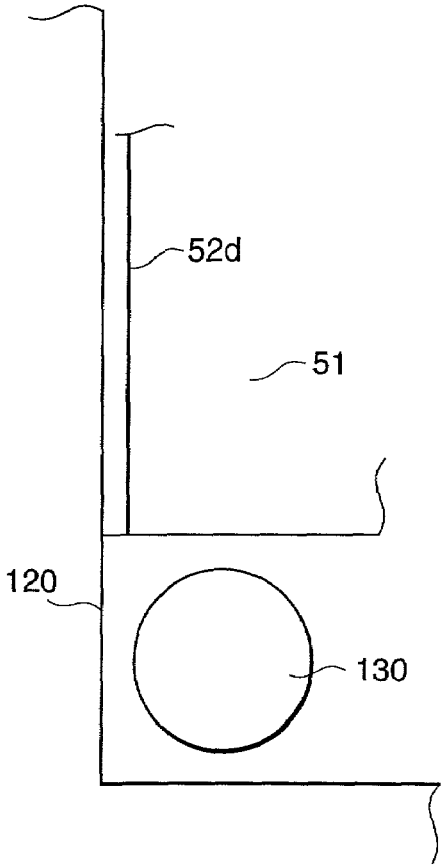
FIG. 9 is a plan view of an end portion in a longitudinal direction of a flange at a midway point of the forming process.
Figure 10:
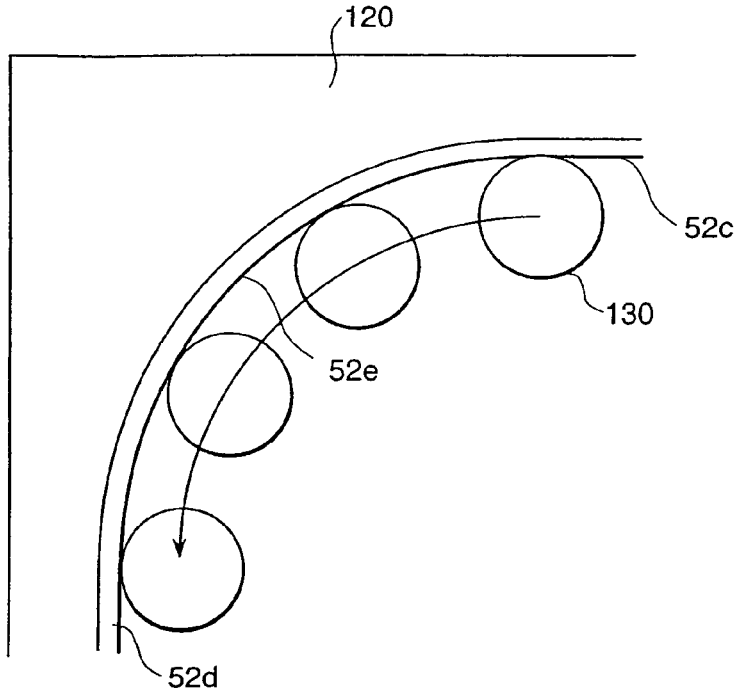
FIG. 10 is a plan view of a circular arc portion at a midway point of the forming process.

In FIG. 9, the tool 130 has moved along the flange 52*d* and has passed through the end portion in the longitudinal direction of the flange 52*d*. Next, the raw material 50*b* is moved reversibly a little to a position in the lower portion of the tool 130. Next, the seat 140 and the tool 130 are lowered. Next, the tool 130 is moved so as to reach the end portion in the longitudinal direction of the flange 52*b* through the flanges 52*c*, 52*e* and 52*d*, successively.

After the tool has passed the end portion of the flange 52*b*, as explained with reference to FIG. 8, the raw material 50*b* is moved reversibly a little to a position in the lower portion of the tool 130. Next, the seat 140 and the tool 130 are lowered. Next, the tool 130 is moved so as to reach the end portion in the longitudinal direction of the flange 52*d* through the flanges 52*b*, 52*e* and 52*d*. Hereinafter, the above stated operation is repeated.

Further, since the flange of the plate 50 is provided on only three sides, the tool 130 is reciprocated as stated above. The former statements "the tool 130 is moved circumferentially in the peripheral direction along the inner peripheral face of the female die 120" etc, include the case of processing on three sides. Further, even when the flange is provided on only three sides, it is unnecessary to reciprocate, but the tool 130 can go all the way around.

After the tool 130 has passed through the end portion in the longitudinal direction of the flanges 52*d*, 52*b*, with movement of the tool 130, the end portion in the longitudinal direction of the flanges 52*d*, 52*b* is sandwiched between the side face of the tool 130 and the inner peripheral face of the female die 120, so that and the end portion in the longitudinal direction of the flanges is formed with a predetermined shape.

Midway in the longitudinal direction of the flange, the movement of the tool 130 is stopped, since the end portion from there does not have a linear shape. Between the end portion of the raw material 50*b* having no flange and the end portion of the female die 120, there is a gap of more than the radius of the tool 130. As the size of the above-stated recessed portion 53, it is necessary to have a space through which the tool 130 can passed.

The portion between the flange 52*b* and the flange 52*c* is removed. Further, the recessed portion 53 is arranged at this location. The distance between the flange 52*b* and the flange 52*c*, namely, the size of the recessed portion 53, is determined so as to press the end portion in the longitudinal direction of the flanges 52*b*, 52*c*, using the side face of the tool 130, against the inner peripheral face of the female die 120. The tool 130 is moved by pressing the end portion in the longitudinal direction of the flanges 52*b*, 52*c*.

When the tool has moved from the flange 52*b* to the flange 52*c*, and the lower end of the tool 130 is in contact with the end face of the bottom plate 51, the tool 130 is raised a little and is moved to the side of the flange 52*c*; after which, the tool 130 is again moved in the longitudinal direction of the flange. Namely, the tool 130 is moved as shown in FIG. 8.

The plate 60 is manufactured similarly. The plate 70 is manufactured similarly. The movement of the tool 130 in the end portion in the longitudinal direction of the flanges 72*b*, 72*c* is carried out similarly.

The processing machine for carrying out the incremental forming is a numeric control system processing apparatus, for example, a NC milling machine or a machining center. On a main shaft of the numeric control system processing apparatus, the tool 130 is installed. The tool 130 is moved up and down along the inner peripheral face of the female die 20 in the vertical direction by numeric control.

The main shaft carrying the tool 130 is moved in the vertical direction and one way in the horizontal direction. The female die 120 and the seat 140 are mounted on a table (the base). The table is moved in the horizontal direction in a rectangular direction relative to the direction of movement in the horizontal direction of the main shaft.

According the above-stated two movements, the tool 130 is moved along the inner peripheral face of the female die 120. The raising and lowering means 150 is mounted on the table. In place of the movement of the tool 130 in the vertical direction, the table can be raised and lowered.

An example will be explained. In this example, the diameter of the tool 130 is 25 mm, the plate thickness of the raw material 50*b* is from 0.5 mm to 4 mm degree, the distance from the inner peripheral face of the female die 120 to the side face of the tool 130 is from 0.8 times to 2 times degree, and the push-in depth for one incremental movement of the tool 130 (the amount of lowering at one time of the seat 140) is 0.5 time to 2 times the plate thickness of the raw material 50*b*. Further, the height of the flange is 20 mm, the radius R of the circular arc (the shoulder portion) of the female die 120 is 5.5–13.5 mm, the diameter of the tool 130 is 25 mm, the radius of the tip end of the tool 130 is from 5.5 mm to 10 mm, and the radius of the circular arc portion 52*e* is 100 mm.

The size of the raw material 50*b* will be explained. As shown in FIG. 7, the size of the raw material 50*b* is such that the edge of the raw material 50*b* is positioned on the upper portion of the female die 120 in line with the center of a circular arc R of the shoulder portion of the female die 120, or the edge of the raw material 50*b* is positioned toward the center of the female die 120 from the position of the above-stated center. When the size of the raw material 50*b* is larger than the above case, in the circular arc portion of the flange, a crack occurs easily in the connection portion between the flange and bottom plate.

In the above-stated embodiment according to the present invention, after the seat 140 has been lowered, the tool 130 is lowered, however the seat 140 and the tool 130 can be lowered at the same time. Further, the tip end of the tool 130 need not be formed with a flat shape, but can be formed with a spherical shape. Further, the tool can be provided so as to not rotate.

The squeezing processing can be carried out by fixing the seat 140 and raising the female die 120. The tool 130 does not move in the vertical direction during the forming in this case. The seat 140 is positioned in the axial direction of the tool 130 and is arranged along the inner peripheral face of the female die 120.

Further, after the tool 130 goes around the circumference along the circular arc portion of the shoulder portion of the female die 130, next the tool 130 is moved along the inner peripheral face of the female die 120, and the tool 130 moves around the female die 120. After the end portion of the raw material is formed with a circular arc shape, the tool 130 is lowered along the inner peripheral face of the female die 120; accordingly, the height of the flange is made even large.

Figure 11:
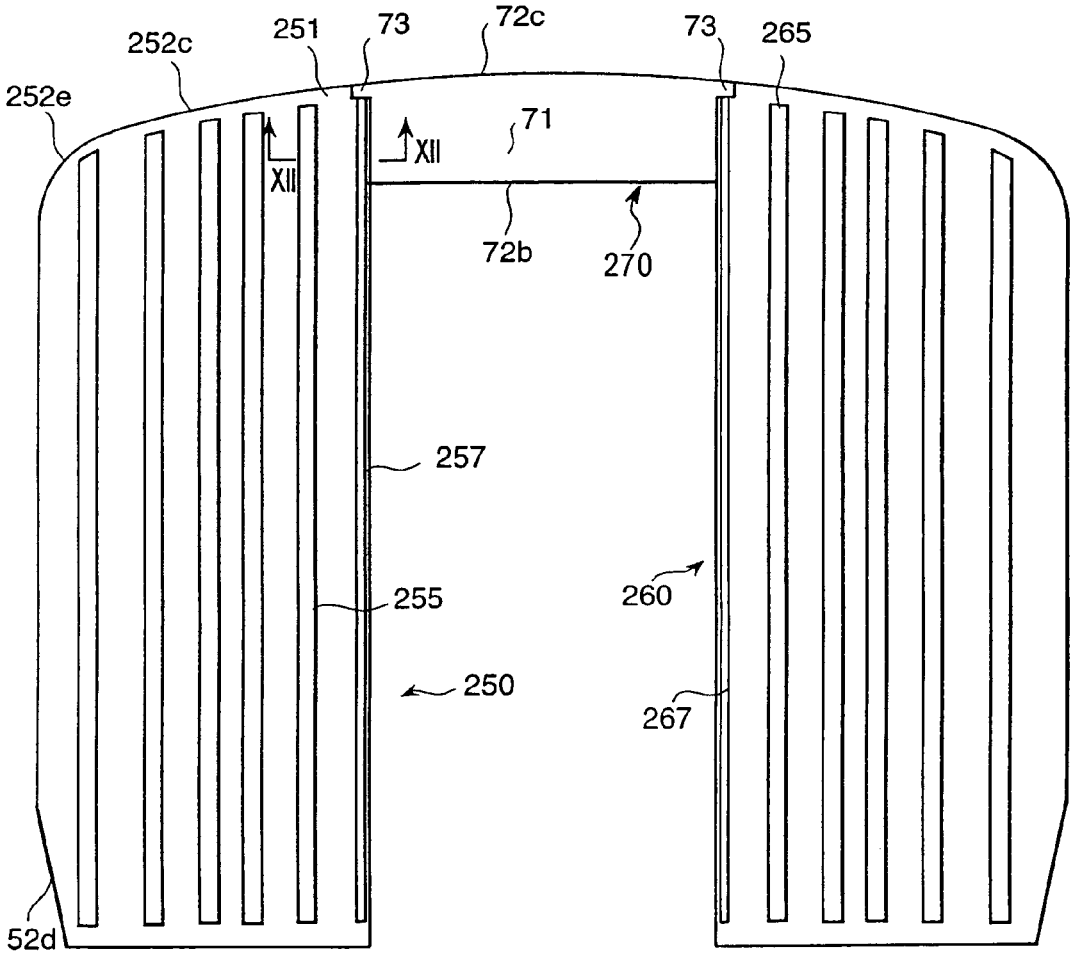
FIG. 11 is a plan view of an end structure of a car body representing another embodiment according to the present invention.
Figure 12:
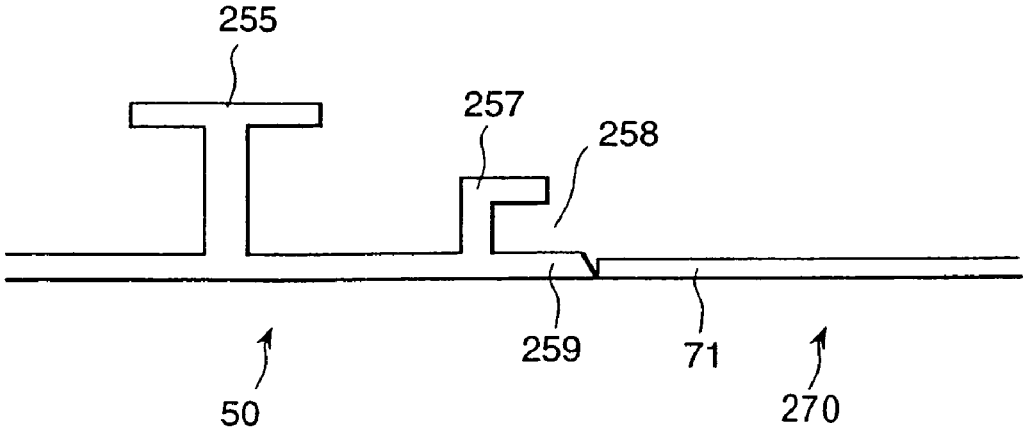
FIG. 12 is cross-sectional view taken along line XII—XII in FIG. 11.
Figure 13:
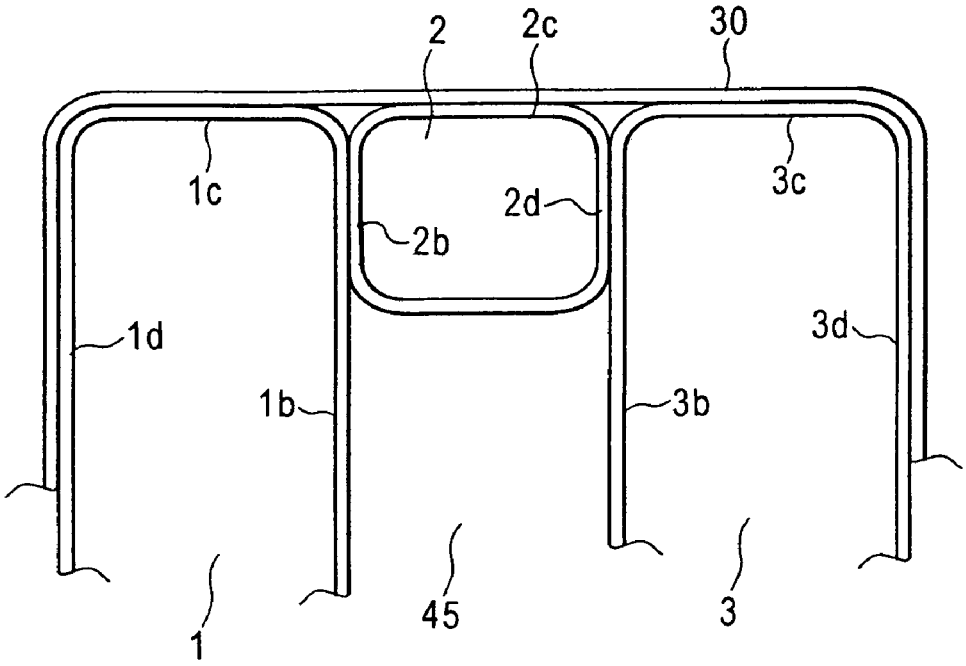
FIG. 13 (PRIOR ART)
FIG. 13 is a diagram of the construction corresponding to the end structure of FIG. 1 as provided in a prior art construction.

An embodiment according to the present invention, as shown in FIG. 11 and FIG. 12, will be explained. A plate 250 (260) corresponding to the plate 50 (60) is constituted by an extruded frame member. The extruded frame member 250 (260) has plural ribs 255 (265). This extruded frame member 250 (260) is subjected to incremental forming. For this purpose, the upper end portion and the lower end portion of the ribs 255 (265) of the extruded frame member 250 (260) are removed by being cut off.

When the thickness of the plate at the upper end portion and the lower end portion of the extruded frame member 250 (260) and the portion of the side face of the car body (the portion for providing the flange 252 (262)) is thick, the face of the rib 255 (265) is cut off, so that the plate thickness becomes suitable for incremental forming.

To the end portion of the side of the plate 270 and the end portion of the side of the passage 45, a rib 257 (267) is provided. The edge of the end portion 259 of the plate 250 is cut off and a welding groove is provided for welding to the end portion of the plate 270.

The size of the protrusion of the rib 257 (267) is smaller than te size of the protrusion of the rib 255 (265). A groove 258 is provided in a plate of the rib 257 (267). The end portion 259 of the plate is arranged at the side of the passage 45 from an end portion of the side of the passage 45 of the rib 257 (267). In the groove 258, an end portion of an interior member (not shown in the figure) is inserted, and by provision of the rib 257 (267, the plate thickness of the end portion of the side of the passage 45 is made thick; as a result, the strength of the flange 255 (265) can be secured.

For this reason, the end portion of the side of the passage 45 is not formed with the rib 257 (267), but the plate thickness of the end portion of the passage 45 side can be formed thick. Further, the flange 255 (265) can be provided by use of extrusion processing. A thick portion is designated generically with respect to the rib 257 (267), the thick plate member and the flange 255 (265).

According to the above-stated embodiment of the present invention, it is unnecessary to provide a member corresponding to the flange 52*b* (62*b*) by bending a flange. Further, it is unnecessary to provide the recessed portion 53. Accordingly, the plate can be formed easily.

The plate 70 can be formed with an extruded frame member similar to the plate 250. The extrusion direction of the plate 70 is the width direction of the car body. The flange 72*b* is formed in the thick portion of the plate 250 (260). Further, the combination of the plate 220 to the plate 270 can change the combination of the plate 50 to the plate 70.

In a case where the plate 250 is not constituted by one extruded frame member, it is possible to use plural extruded frame members that are welded. This joining (the welding) can be carried out, for example, using friction stir welding. The plate 270 can be formed of an extruded frame member.

It is possible to mount a male die on the raw material and bend the outer peripheral portion of the raw material using a tool moving the outer peripheral portion of the male die in the manufacture of a flange. Further, the plates 50, 60, 70 can be manufactured using press processing.

According to the present invention, the two products having a flange in the end portion of the plate and a third plate can be welded without a gap (clearance).

What is claimed is:

1. A manufacturing method of a structural body, characterized in that manufacturing a first plate and a second plate for abutting and welding said first plate;

said first plate comprising a first flange provided by bending a first side of said first plate, a second flange being orthogonal substantially to said first flange and provided by bending a second side of said first plate, and a recessed portion between an end portion in a longitudinal direction of said first flange and an end portion in a longitudinal direction of said second flange;

said second plate comprising a third flange provided by bending a first side of said second plate and for connecting to said end portion in the longitudinal direction of said first flange, and an extended portion protruded from a third side of said second plate, said third side being orthogonal substantially to said first side of said second plate and to a second side which is parallel substantially to said first side, said extended portion extending to a vicinity of an end portion in a longitudinal direction of said third flange;

abutting said end portion in the longitudinal direction of said first flange and said end portion of the longitudinal direction of said third flange;

abutting said third side to an outer side of a circular arc of said second flange from said first plate;

inserting and abutting said extended portion to said recessed portion; and welding the respective abutted portions.

2. A manufacturing method of a structural body according to claim 1, characterized in that said recessed portion includes a portion of a bottom plate of said first plate; and said extended portion includes a portion of a bottom plate of said second plate.

3. A manufacturing method of a structural body according to claim 1, characterized in that said second plate has a fourth flange in which a second side being parallel substantially to said first side of said second plate is bent, an end portion in a longitudinal direction of said fourth flange is positioned in a retreat position from said third side;

an end portion in the longitudinal direction of said fourth flange is abutted to said second flange; and said abutted portion is welded.

4. A manufacturing method of a structural body according to claim 1, characterized in that to said second plate a thick portion is provided along to said second side;

an end portion in a longitudinal direction of said second side is positioned in a retreat position from said third side;

an end portion in the longitudinal direction of said thick portion is abutted to said second flange; and said abutted portion is welded.

5. A manufacturing method of a structural body, characterized in that manufacturing a first plate and a second plate for abutting and welding said first plate;

said first plate being an extruded frame member and comprising plural ribs along to an extrusion direction, a thick portion provided along to a side which is an end portion in an orthogonal direction against said extrusion direction, a plate portion except for said rib of an end portion of said extrusion direction and said thick portion, and a first flange provided by bending said end portion of said plate portion to a side of said rib;

said second plate comprising a third flange provided by bending a first side;

abutting an end portion in the longitudinal direction of said first flange and an end portion in the longitudinal direction of said third flange;

abutting a third side of said second plate which is orthogonal substantially to said third flange to an end portion of said thick portion of said first plate; and welding the respective abutted portions.

6. A manufacturing method of a structural body according to claim 5, characterized in that between said end portion in the longitudinal direction of said first flange and said end portion in the longitudinal direction of said thick portion, manufacturing said first plate to which a recessed portion except for said first flange and said plate portion of a side of said thick portion is provided;

manufacturing said second plate having an extended portion in which an end portion in the longitudinal direction of said third flange and a vicinity of said end portion is protruded from said third side;

inserting and abutting said extended portion to said recessed portion; and welding said abutted portion.

7. A manufacturing method of a structural body according to claim 6, characterized in that said recessed portion includes a bottom plate of said plate portion of said first plate; and said extended portion includes a portion of a bottom plate of said second plate.

8. A manufacturing method of a structural body according to claim 5, characterized in that said second plate has a fourth flange in which a second side being parallel substantially to said first side of said second plate is bent;

an end portion in the longitudinal direction of said fourth flange is abutted to said thick portion of said first plate; and said abutted portion is welded.

9. A manufacturing method of a structural body according to claim 5, characterized in that said second plate is an extruded frame member and an extrusion direction of said extruded frame member is a longitudinal direction of said third flange;

a second side being parallel substantially to said first side of said second plate forms a thick portion;

an end portion in the longitudinal direction of a thick portion of said second plate is abutted to said thick portion of said first plate; and said abutted portion is welded.

10. A structural body, characterized in that a first plate and a second plate are welded;

said first plate comprises a first flange provided by bending a first side of said first plate, a second flange being orthogonal substantially to said first flange and provided by bending a second side of said first plate, and a recessed portion between an end portion in a longitudinal direction of said first flange and an end portion in a longitudinal direction of said second flange;

said second plate comprises a third flange provided by bending a first side of said second plate and for connecting to said end portion in the longitudinal direction of said first flange, and an extended portion protruded from a third side of said second plate, said third side being orthogonal substantially to said first side of said second plate and to a second side which is parallel substantially to said first side, said extended portion extending to a vicinity of an end portion in a longitudinal direction of said third flange;

said end portion in the longitudinal direction of said first flange and said end portion in the longitudinal direction of said third flange are abutted;

said third side to an outer side of a circular arc of said second flange from said first plate are abutted;

said extended portion is inserted and abutted to said recessed portion; and the respective abutted portions are welded.

11. A structural body according to claim 10, characterized in that said recessed portion includes a portion of a bottom plate of said first plate; and said extended portion includes a portion of a bottom plate of said second plate.

12. A structural body according to claim 10, characterized in that to said second plate a fourth flange in which a second side being parallel substantially to said first side of said first plate is provided; and an end portion in a longitudinal direction of said fourth flange is welded to said second flange of said first plate.

13. A structural body according to claim 10, characterized in that to said second plate a thick portion is provided along to said second side; and an end portion in the longitudinal direction of said thick portion is welded to said second flange.

14. A structural body, characterized in that an extruded frame member and a second plate are welded;

said extruded frame member comprises plural ribs along to an extrusion direction, a thick portion provided along to a side which is an end portion in an orthogonal direction against said extrusion direction, a plate portion except for said rib of an end portion in said extrusion direction and said thick portion, and a first flange provided by bending said end portion of said plate portion to a side of said rib;

said second plate comprises a third flange provided by bending a first side;

an abutted portion of an end portion in the longitudinal direction of said first flange and an end portion of the longitudinal direction of said third flange is welded; and an abutted portion of a third side of said second plate which is orthogonal substantially to said third flange to an end portion of said thick portion of said first plate is welded.

15. A structural body according to claim 14, characterized in that between said end portion in the longitudinal direction of said first flange and said end portion in the longitudinal direction of said thick portion, said extruded frame member has a recessed portion except for said first flange and a side of said plate portion of said thick portion;

said second plate has an extended portion in which an end portion in the longitudinal direction of said third flange and a vicinity of said end portion is protruded from a third side;

said extended portion is inserted to said recessed portion; and said abutted portion is welded.

16. A structural body according to claim 15, characterized in that said recessed portion includes a bottom plate of said plate portion of said extruded frame member; and said extended portion includes a portion corresponding to a portion of said bottom plate.

17. A structural body according to claim 14, characterized in that to said second plate a fourth flange in which a second side being parallel substantially to said first side of said first plate is provided; and an end portion in a longitudinal direction of said fourth flange is welded to said thick portion of said first plate.

18. A structural body according to claim 14, characterized in that said second plate is an extruded frame member and an extrusion direction of said extruded frame member is a longitudinal direction of said third flange;

a second side being parallel substantially to said first side of said second plate forms a thick portion; and an end portion in the longitudinal direction of a thick portion of said second plate is welded to said thick portion of said extruded frame member.

19. A car body of a railway vehicle, characterized in that an end structure of said car body of the railway vehicle comprises a first plate, a second plate, and a third plate;

said second plate constitutes a member between an upper portion of a passenger passage and a roof of said car body, and said second plate is welded to said roof;

said first plate and said third plate are provided in a right side and a left side, and said first plate and said third plate are welded to said second plate, respectively;

said first plate and said third plate constitute a member between said passenger passage and a side face of said car body;

said first plate and said third plate are overlapped and welded on said side face of said car body and said roof;

said first plate and said third plate comprise a first flange provided by bending said plates along to said roof and said side face of said car body, a second flange provided by bending said plates along to said passenger passage, and a recessed portion except for a flange between an end portion in a longitudinal direction of said first flange and an end portion in a longitudinal direction of said second flange;

said second plate comprises a third flange provided along to said roof and for connecting to an end portion in a longitudinal direction of said first flange, an extended portion protruded from a third side which is orthogonal substantially to a first side of said second plate and extends to a vicinity of an end portion in a longitudinal direction of said third flange;

an abutted portion of said end portion in the longitudinal direction of said first flange and said end portion of the longitudinal direction of said third flange is abutted; and an abutted portion of said third side to an outer side of a circular arc of said second flange from said first plate and an abutted portion of said extended portion to said recessed portion by inserting said extended portion is welded.

20. A car body of a railway vehicle according to claim 19, characterized in that said recessed portion includes a portion of a bottom plate of said first plate and a portion of a bottom plate of said third plate; and said extended portion includes a portion of a bottom plate of said second plate.

21. A car body of a railway vehicle according to claim 19, characterized in that to said second plate a fourth flange in which a second side being parallel substantially to said first side of said first plate is provided; and an end portion in a longitudinal direction of said fourth flange is welded to said second flange.

22. A car body of a railway vehicle according to claim 19, characterized in that to said second plate a thick portion is provided to said flange along to parallel substantially to a second side; and an end portion in the longitudinal direction of said thick portion is welded to said flange.

23. A car body of a railway vehicle, characterized in that an end structure of said car body of the railway vehicle comprises a first plate, a second plate, and a third plate;

said second plate constitutes a member between an upper portion of a passenger passage and a roof of said car body, and said second plate is welded to said roof;

said first plate and said third plate are provided in a right side and a left side, and said first plate and said third plate are welded to said second plate, respectively;

said first plate and said third plate constitute a member between said passenger passage and a side face of said car body;

said first plate and said third plate are overlapped and welded on said side face of said car body and said roof;

said first plate and said third plate are extruded frame members and an extrusion direction of said plates is a vertical direction of said car body;

said first plate and said third plate being said extruded frame members comprise plural ribs along to an extrusion direction, a thick portion provided along to a side which is an end portion in an orthogonal direction against said extrusion direction, a plate portion except for said rib in said end portion in said extrusion direction and said thick portion, and a first flange in which said end portion of said plate portion along to said roof and a side face of said car body;

said second plate comprises a third flange provided by bending a first side;

an abutted portion of said end portion in the longitudinal direction of said first flange and said end portion in the longitudinal direction of said third flange is welded; and an abutted portion of said third side being orthogonal substantially to said third flange and said end portion of said thick portion of said first plate is welded.

24. A car body of a railway vehicle according to claim 23, characterized in that between an end portion in a longitudinal direction of said first flange and an end portion in a longitudinal direction of said thick portion, said frame member has a recessed portion except for said first flange and said plate portion of a side of said thick portion;

said second plate has an extended portion which protrudes an end portion in a longitudinal direction of said third flange and a vicinity of said end portion from a third side;

said extended portion is inserted to said recessed portion; and an abutted portion is welded.

25. A car body of a railway vehicle according to claim 24, characterized in that said recessed portion includes a portion of a bottom plate of said plate portion of said extruded frame member; and said extended portion includes a portion corresponding to a portion of a bottom plate.

26. A car body of a railway vehicle according to claim 23, characterized in that to said second plate a fourth flange in which a second side being parallel substantially to said first side of said first plate is provided; and an end portion in a longitudinal direction of said fourth flange is welded to said thick portion of said extruded frame member.

27. A car body of a railway vehicle according to claim 23, characterized in that said second plate is an extruded frame member and an extrusion direction of said extruded frame member is a longitudinal direction of said third flange;

a second side being parallel substantially to said first side of said second plate forms a thick portion; and an end portion in the longitudinal direction of a thick portion of said second plate is welded to said thick portion of said extruded frame member.

28. A manufacturing method of a structural body characterized in that manufacturing a first plate and a second plate for abutting and welding said first plate;

said first plate comprising a first flange provided by bending a first side of said first plate, a second flange being orthogonal substantially to said first flange and provided by bending a second side of said first plate, and a recessed portion between an end portion in a longitudinal direction of said first flange and an end portion in a longitudinal direction of said second flange;

said second plate comprising a third flange provided by bending a first side of said second plate and for connecting to said end portion in the longitudinal direction of said first flange, and an extended portion protruded from a third side of said second plate, said third side being orthogonal substantially to said first side of said second plate and to a second side which is parallel substantially to said first side, said extended portion extending to a vicinity of an end portion in a longitudinal direction of said third flange;

abutting said end portion in the longitudinal direction of said first flange and said end portion of the longitudinal direction of said third flange;

abutting said third side to an outer side of a circular arc of said second flange from said first plate;

inserting and abutting said extended portion to said recessed portion; and welding the respective abutted portions, and characterized in that respective flanges are formed in respective plates using a female die and a rod shaped tool, wherein a shape of an inner peripheral face of said female die corresponds to a desired outer shape of each of said respective plates, by a process comprising:

inserting said rod shaped tool into an interior portion of said female die;

lowering said rod shaped tool by an incremental amount along a vertical inner peripheral face of said female die; and moving said rod shaped tool along the inner peripheral face of said female die to form respective flanges on respective plates.

29. A manufacturing method of a structural body according to claim 28, further comprising, in forming respective flanges in respective plates, rotating said rod shaped tool on its axis while moving the tool, and, after said rod shaped tool is moved entirely around the inner peripheral face of said female die, again lowering said rod shaped tool by an incremental amount and moving said rod shaped tool along the inner peripheral face of said female die.

30. A manufacturing method of a structural body according to claim 5, characterized in that respective flanges are formed in respective plates using a female die and a rod shaped tool, wherein a shape of an inner peripheral face of said female die corresponds to a desired outer shape of each of said respective plates, by a process comprising:

inserting said rod shaped tool into an interior portion of said female die;

lowering said rod shaped tool by an incremental amount along a vertical inner peripheral face of said female die; and moving said rod shaped tool along the inner peripheral face of said female die to form respective flanges on respective plates.

31. A manufacturing method of a structural body according to claim 30, further comprising, in forming respective flanges in respective plates, rotating said rod shaped tool on its axis while moving the tool, and, after said rod shaped tool is moved entirely around the inner peripheral face of said female die, again lowering said rod shaped tool by an incremental amount and moving said rod shaped tool along the inner peripheral face of said female die.

32. A structural body characterized in that a first plate and a second plate are welded;

said first plate comprises a first flange provided by bending a first side of said first plate, a second flange being orthogonal substantially to said first flange and provided by bending a second side of said first plate, and a recessed portion between an end portion in a longitudinal direction of said first flange and an end portion in a longitudinal direction of said second flange;

said second plate comprises a third flange provided by bending a first side of said second plate and for connecting to said end portion in the longitudinal direction of said first flange, and an extended portion protruded from a third side of said second plate, said third side being orthogonal substantially to said first side of said second plate and to a second side which is parallel substantially to said first side, said extended portion extending to a vicinity of an end portion in a longitudinal direction of said third flange;

said end portion in the longitudinal direction of said first flange and said end portion in the longitudinal direction of said third flange are abutted;

said third side to an outer side of a circular arc of said second flange from said first plate are abutted;

said extended portion is inserted and abutted to said recessed portion; and the respective abutted portions are welded, characterized in that respective flanges are formed in respective plates using a female die and a rod shaped tool, wherein a shape of an inner peripheral face of said female die corresponds to a desired outer shape of each of said respective plates, by a process comprising:

inserting said rod shaped tool into an interior portion of said female die;

lowering said rod shaped tool by an incremental amount along a vertical inner peripheral face of said female die; and moving said rod shaped tool along the inner peripheral face of said female die to form respective flanges on respective plates.

33. A structural body according to claim 32, further comprising, in forming respective flanges in respective plates, rotating said rod shaped tool on its axis while moving the tool, and, after said rod shaped tool is moved entirely around the inner peripheral face of said female die, again lowering said rod shaped tool by an incremental amount and moving said rod shaped tool along the inner peripheral face of said female die.

34. A structural body according to claim 14, characterized in that respective flanges are formed in respective plates using a female die and a rod shaped tool, wherein a shape of an inner peripheral face of said female die corresponds to a desired outer shape of each of said respective plates, by a process comprising:

inserting said rod shaped tool into an interior portion of said female die;

lowering said rod shaped tool by an incremental amount along a vertical inner peripheral face of said female die; and moving said rod shaped tool along the inner peripheral face of said female die to form respective flanges on respective plates.

35. A structural body according to claim 34, further comprising, in forming respective flanges in respective plates, rotating said rod shaped tool on its axis while moving the tool, and, after said rod shaped tool is moved entirely around the inner peripheral face of said female die, again lowering said rod shaped tool by an incremental amount and moving said rod shaped tool along the inner peripheral face of said female die.

36. A car body of a railway vehicle characterized in that an end structure of said car body of the railway vehicle comprises a first plate, a second plate, and a third plate;

said second plate constitutes a member between an upper portion of a passenger passage and a roof of said car body, and said second plate is welded to said roof;

said first plate and said third plate are provided in a right side and a left side, and said first plate and said third plate are welded to said second plate, respectively;

said first plate and said third plate constitute a member between said passenger passage and a side face of said car body;

said first plate and said third plate are overlapped and welded on said side face of said car body and said roof;

said first plate and said third plate comprise a first flange provided by bending said plates along to said roof and said side face of said car body, a second flange provided by bending said plates along to said passenger passage, and a recessed portion except for a flange between an end portion in a longitudinal direction of said first flange and an end portion in a longitudinal direction of said second flange;

said second plate comprises a third flange provided along to said roof and for connecting to an end portion in a longitudinal direction of said first flange, an extended portion protruded from a third side which is orthogonal substantially to a first side of said second plate and extends to a vicinity of an end portion in a longitudinal direction of said third flange;

an abutted portion of said end portion in the longitudinal direction of said first flange and said end portion of the longitudinal direction of said third flange is abutted; and an abutted portion of said third side to an outer side of a circular arc of said second flange from said first plate and an abutted portion of said extended portion to said recessed portion by inserting said extended portion is welded, and characterized in that respective flanges are formed in respective plates using a female die and a rod shaped tool, wherein a shape of an inner peripheral face of said female die corresponds to a desired outer shape of each of said respective plates, by a process comprising:

inserting said rod shaped tool into an interior portion of said female die;

lowering said rod shaped tool by an incremental amount along a vertical inner peripheral face of said female die; and moving said rod shaped tool along the inner peripheral face of said female die to form respective flanges on respective plates.

37. A car body of a railway vehicle according to claim 36, further comprising, in forming respective flanges in respective plates, rotating said rod shaped tool on its axis while moving the tool, and, after said rod shaped tool is moved entirely around the inner peripheral face of said female die, again lowering said rod shaped tool by an incremental amount and moving said rod shaped tool along the inner peripheral face of said female die.

38. A car body of a railway vehicle according to claim 23, respective flanges are formed in respective plates using a female die and a rod shaped tool, wherein a shape of an inner peripheral face of said female die corresponds to a desired outer shape of each of said respective plates, by a process comprising:

inserting said rod shaped tool into an interior portion of said female die;

lowering said rod shaped tool by an incremental amount along a vertical inner peripheral face of said female die; and moving said rod shaped tool along the inner peripheral face of said female die to form respective flanges on respective plates.

39. A car body of a railway vehicle according to claim 38, further comprising, in forming respective flanges in respective plates, rotating said rod shaped tool on its axis while moving the tool, and, after said rod shaped tool is moved entirely around the inner peripheral face of said female die, again lowering said rod shaped tool by an incremental amount and moving said rod shaped tool along the inner peripheral face of said female die.

* * * * *